United States Patent [19]

Finney

[11] Patent Number: 4,516,374

[45] Date of Patent: May 14, 1985

[54] MEANS FOR AND METHOD OF FURNACE INSULATION

[76] Inventor: John F. Finney, 915 E. 15th, Winfield, Kans. 67156

[21] Appl. No.: 424,310

[22] Filed: Sep. 27, 1982

[51] Int. Cl.[3] ..... E04B 1/74

[52] U.S. Cl. ..... 52/404; 52/509; 52/747; 52/714; 110/336

[58] Field of Search ..... 52/404, 508, 509, 511, 52/747, 592, 713, 714; 110/336, 338

[56] References Cited

U.S. PATENT DOCUMENTS

| | | | |
|---|---|---|---|
| 2,580,231 | 12/1951 | Lamm | 52/714 X |
| 3,854,262 | 12/1974 | Brady | 52/404 |
| 3,924,039 | 12/1975 | Smith, Jr. | 52/404 X |
| 4,103,469 | 8/1978 | Byrd, Jr. | 52/509 |
| 4,123,886 | 11/1978 | Byrd, Jr. | 52/509 |
| 4,202,148 | 5/1980 | Frahme et al. | 52/592 |
| 4,218,962 | 8/1980 | Cunningham et al. | 52/509 X |

*Primary Examiner*—Carl D. Friedman
*Attorney, Agent, or Firm*—Robert E. Breidenthal

[57] ABSTRACT

An insulation module fabricated from ceramic fiber blanket material. The module includes a horizontal base of blanket material and body portion of blanket material secured to the top thereof. The body may be blanket material in a zigzag or Z-configuration with free ends seated against the base or a series of U-folds with the bight portions thereof being remote and directed from the base. Alternatively, the body can be blanket material wound into helix of an overall rectangular cross section and having its free edge seated against the base. The base can be formed of superposed blankets that are staggered or offset so as to make rabbet-like joints with corresponding parts of adjacent modules. The modules, which are generally of rectangular configuration, are provided with protective covers that protect them, retain them in a prestressed (laterally compressed trapezoidal) condition, and which facilitate installation. Bifurcated retainer bar supports coact with retainer bars upon which the modules are skewered to hold the modules in position. The bars extend in the direction of lateral module compression with adjacent ends of approximately aligned retainer bars associated with adjacent modules sharing a bifurcated support and extending in overlapping relationship through its bifurcation wherein they secure by the support being crimped thereabout. A novel installation procedure is disclosed.

25 Claims, 16 Drawing Figures

FIG. 1
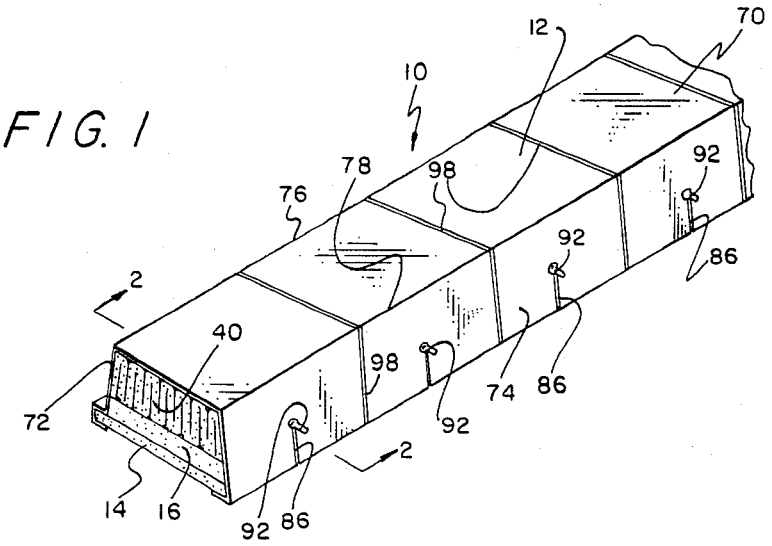
FIG. 2
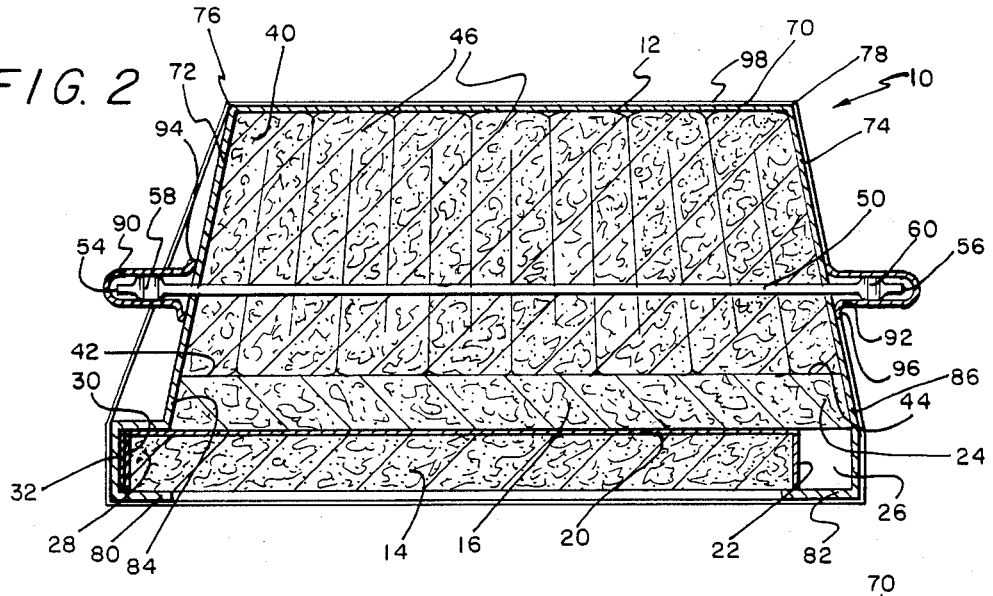
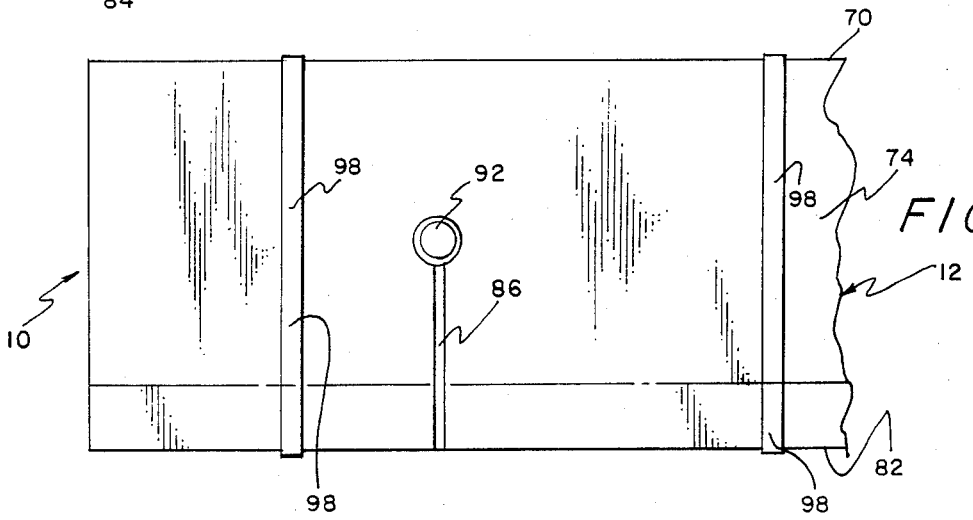
FIG. 3

FIG. 9
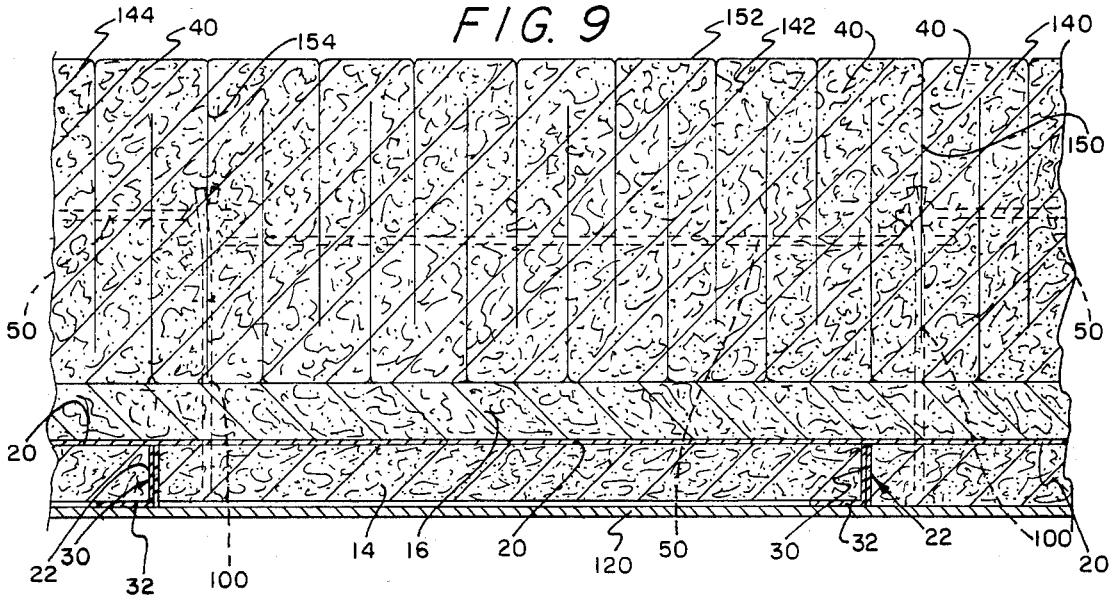
FIG. 12
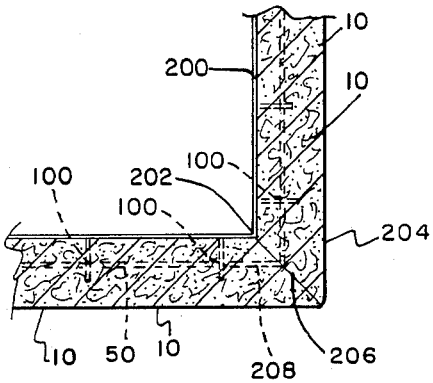
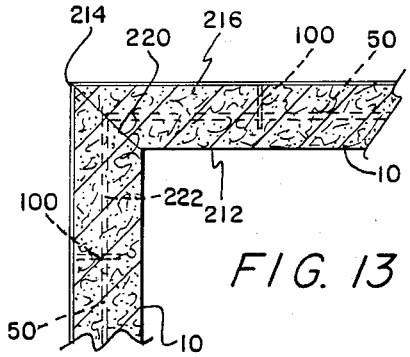
FIG. 13
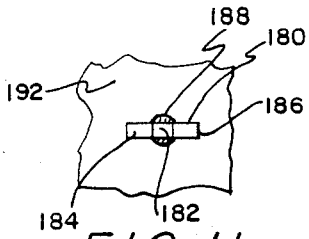
FIG. 11
FIG. 10
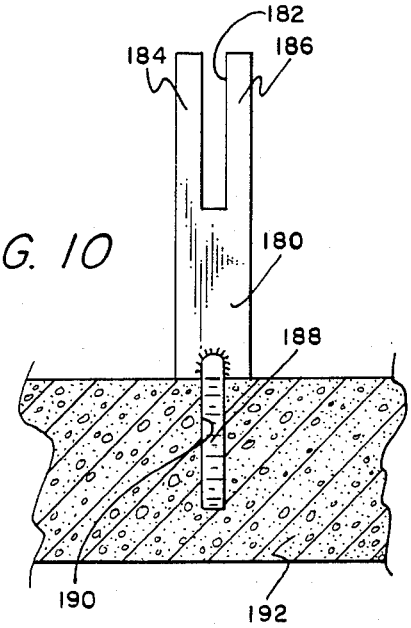

MEANS FOR AND METHOD OF FURNACE INSULATION

The present invention relates to new and useful improvements in thermal insulation, and more particularly pertains to new and improved high temperature insulation modules and means for mounting the same as well as to steps performed in the mounting of the same.

An appreciation of the character of insulation modules in current use and the materials of which they are fabricated may be obtained on inspection of advertising leaflets of A. P. Green Refractories Co. of Mexico, Mo. 65265, with the composition, sizes and thermal characteristics of some commercially available ceramic fiber blankets being disclosed in leaflets identified as BLT-1/ML-107908; BR-1/ML-107908; BHT-1/ML-107908; and BHP-1/ML-107908. A leaflet identified as INT-23/ML-780605 discloses a treating agent or inorganic rigidizer for blankets. One leaflet entitled INSWOOL MODULES is of interest as it discloses modules having blankets of a Z-configuration and called "Accordian Pleated" as well as a set of U-folds simply called "Folded", with a notice to the effect that "patent applied for".

A booklet published by Johns-Manville, Denver, Colo. 80217, pertaining to refractory products application information entitled Z-Blok Installation Guide (Z-Blok being a registered trademark). The booklet, authored by James E. Neal, is additionally identified as "Section: 210-0 Part II Date: 2-81 Cancels: 1-80" is of interest in showing modules of Z-folded blankets and the installation thereof in a parquet fashion.

The disclosures of the above publications are incorporated herein by reference as are the disclosures of the following U.S. patents that constitute prior art proposals of value in acquiring a background understanding of the present invention:

| | | |
|---|---|---|
| 3,832,815 | Balaz et al | Sept. 3, 1974 |
| 3,854,262 | Brady | Dec. 17, 1974 |
| 3,952,470 | Byrd, Jr. | Apr. 27, 1976 |
| 3,892,396 | Monaghan | July 1, 1975 |
| 4,157,001 | Pickles | June 5, 1979 |
| 4,233,468 | Northup, Jr. | Nov. 11, 1980 |
| 3,738,217 | Walker | June 12, 1973 |
| 3,523,395 | Rutter et al | Aug. 11, 1970 |

In the order listed above, Balaz et al is of interest in showing pins extending through a plurality of blanket layers and secured at their ends to a base structure, and in showing a parquet configuration. Brady discloses blankets impaled upon mountng pins. Byrd, Jr., discloses folded blankets with members in the folds connected to wall mounting structure as well as preformed insulation blocks. Monaghan discloses blanket layers impaled on L-shaped pins. Pickles discloses pins or studs secured to a wall that extend through blanket layers. The studs are notched whereby ceramic heads can be engaged on the studs to hold the layers. Northrup, Jr., discloses studs fixed to a wall with blanket layers impaled thereon. The layers are retained by anchor washers secured to the studs. Walker is of interest for essentially the reasons as Northrup, Jr. Rutter et al discloses a composite pin wherein the outermost portion upon which the insulation is impaled is ceramic, and wherein a ceramic anchor washer retains the insulation on the ceramic end of the composite pin or stud.

Modules as heretofore proposed and as heretofore installed are subject to several significant shortcomings amongst which might be mentioned a lack of uniform lateral compression, particularly unidirectional compression; impossibility of orienting each module to optimize its resistence to erosion and other deleterious effects of the flow of hot gases thereagainst; inadequate protection of mounting devices against high temperatures; that repair or replacement of a small damaged area of insulation ordinarily requires replacement of a relatively much larger area of insulation; modules are quite susceptible to damage during storage, shipping and installation; individual modules are typically square and are limited in practice to coverage of a small area; and installation is tedious, time consuming, and subjects the modules to a high risk of damage lest great care is observed.

It is the object of the present invention to provide insulation modules, together with mounting means and techniques that will obviate or at least significantly alleviate all of the shortcomings set forth above.

Broadly, the invention involves an improved means for mounting a ceramic fiber module comprising a pair of retainer bar supports each having first and second ends with the first end being adapted to be secured to a furnace wall, whereby the supports may be spaced from each other and secured to a wall to project their second ends therefrom, an elongated retainer bar which is adapted to extend laterally through a module, said second end of each of the supports being provided with means for holding an end of the retainer bar, whereby a module positioned against a furnace wall intermediate the supports will be constrained against lateral movement by the supports and against movement from the furnace wall by the retainer bar held at its ends by the spaced supports.

More specifically, the invention additionally involves the inclusion of a second retainer bar, wherein the means at the second end of each support is such as to enable the holding of ends of both retainer bars when the latter are disposed in approximate alignment with each other, whereby each support can hold adjacent ends of approximately aligned retainer bars that extend through laterally adjacent modules on opposite sides of the support.

Said invention also involves an improved ceramic fiber thermal insulation module comprising a body portion constituted of at least one length of a ceramic fiber blanket, said module including a horizontal base underlying the body portion that is also formed of a ceramic fiber blanket material, with a lateral portion thereof projecting laterally at one side of the module to constitute a tongue, said module having a configuration at its other side that defines a recess horizontally bounded by the base, whereby the tongue of one module can mate with the recess of a laterally adjoining module, said length of blanket having a fiber orientation therein that is essentially parallel to the local extent of the blanket, said body portion being secured to the base and generally rectangular in transverse section and substantially continuous and substantially free of voids other than those intermediate fibers that are adjacent to each other within a blanket, with each length of said blanket constituting having two ends and being so arranged that both of said ends are remote from the uppermost and generally horizontal surface of the body portion.

Other aspects of the invention involve the provision of vapor barriers to exclude vapors and components thereof contacting or condensing upon the insulated shell or wall, and especially to the provision of a protective cover that protects and holds the module in lateral compression in a generally trapezoidal configuration until installation.

Numerous other objectives, features and advantages will become manifest during the ensuing description of preferred embodiments thereof, such description being given in conjunction with the accompanying drawings illustrative thereof, wherein:

FIG. 1 is an isometric view of a packaged thermal module ready for installation;

FIG. 2 is an enlarged transverse sectional view of the packaged module shown in FIG. 1, with the nylon straps deleted, the view being taken on the section line 2—2 in FIG. 1;

FIG. 3 is a fragmentary side elevational view of an end portion of the module shown in FIG. 1;

FIG. 9 is an enlarged and fragmentary transverse sectional view illustrating installed modules after the removal of their protective covers and illustrates the disposition of aluminum foil between adjacent and overlapping modules, as well as showing the abutting relationship of adjacent modules on removal of their protective covers with hidden details being shown in dashed outline;

FIG. 10 is a front elevational view of a modified retainer bar support suitable for attachment to masonry by means of the provision of a stud integral therewith that may be cemented in a socket formed in a masonry wall as fragmentarily illustrated in section;

FIG. 11 is a plan view of the structure shown in FIG. 10;

FIG. 12 is a sectional view illustrating the manner in which thermal modules are mounted on a wall or shell having a convex dihedral angle therein;

FIG. 13 is a view similar to FIG. 12 relative to a concave dihedral angle;

Figure 7:
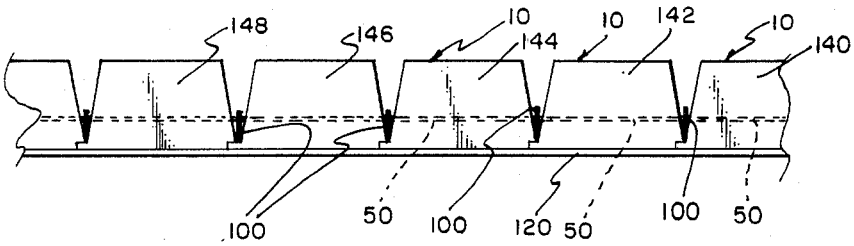
FIG. 7 is an elevational view on a diminutive scale of a series of modules mounted in side-by-side relationship on a planar wall or shell, with the modules being retained by retainer bars shown in dashed outline and with the modules being shown in their trapezoidally compressed condition by their, as yet to be removed, protective covers.

Referring now to the drawings, wherein like numerals designate like parts throughout the various views, and directing attention initially to the form of the invention shown in FIGS. 1 through 9, inclusively, the reference numeral 10 designates a thermal insulation module generally, the same being shown in FIG. 1 as compressively embraced into a trapezoidal configuration by a protective casing or cover 12 that may be conveniently formed of a cardboard type of sheet material of about 3/16" to ¼" thickness, and folded into the configuration shown. If deemed necessary or expedient for purpose of protection prior to installation, a conventional shrink pack of polyvinyl material, not shown, can be applied to surround the assembled cardboard cover 12 and the module compressed therein according to conventional practices.

The module 10 is comprised primarily of a blanket of ceramic fiber material. The ceramic fiber material is primarily comprised of alumina and silica, and may include minor or trace quantities of other oxides such as of titanium. The ratio of alumina to silica is usually selected to be relatively greater when the temperatures to which the module 10 is to be exposed are higher.

Blankets of ceramic fiber suitable for use in the present invention are commercially available from a number of sources in a considerable assortment of dimensions relative to thickness (one to two inches being commonplace), width (two to four feet being commonplace), and length (lengths of at least 25 feet being readily available). As well known, the ceramic fibers are highly organized in their orientation and preferentially external in the direction of the longitudinal extent or major dimension of the blanket, i.e., normal to the thickness and the width thereof.

In contrast to conventional modules that are of square configuration for installing in a paraquet pattern, i.e., a checkerboard layout with each module being oriented at right angles with respect to abutting modules; the modules of the present invention are of rectangular configuration so that sizeable areas can be insulated with modules in side-by-side abutting relation being oriented parallel to each other.

The module 10 is comprised of a pair of rectangular blankets or pads 14 and 16 each having the desired width and length of the module, say, for example, one foot wide by 25 feet in length, with the blanket 16 being superposed on the blanket 14 and offset to one side about one inch. A layer of aluminum foil 20 is interposed between the blankets 14 and 16 and the blankets are secured by any suitable cement such as 3M No. 33 cement to the portion of the aluminum foil directly between the blankets 14 and 16. The aluminum foil projects laterally along one edge of the lower blanket 14 and is folded downwardly to abut the vertical extent of the lateral edge of the blanket 14 as indicated at 22. As will be evident on inspection of FIG. 2, the laterally projecting extent 24 of the blanket 16 defines jointly with the layer 14 a pocket or recess 26 that is faced by the downturned aluminum foil 22 along the longitudinal extent of the module 10.

The laterally projecting marginal edge portion of the blanket 14 constitutes a tongue 28, and the aluminum foil 20 projects laterally a sufficient extent to extend over the tongue 28, and thence vertically downwardly along the vertical edge of the tongue 28 as shown at 30. The lateral extent of the aluminum foil 20 has an excess of approximately the thickness of the blanket 14 beyond that sufficient to extend to the bottom of the blanket 14, and such excess 32 may be folded upwardly as shown in FIG. 2 as will be more fully explained hereinafter.

A rectangular blanket 40 which may conveniently be of any width up to about four feet and 25 feet in length is folded in a zigzag or Z-like configuration and disposed with its lateral edges 42 and 44 seated and cemented to the upper lateral margins of the blanket 24. Recalling that the blanket 16 has a width of one foot, the number of folds 46 is sufficient to realize the adjacent folds compressively abutting each other and is determined by the thickness of the blanket 40 employed. When the blanket 40 has a thickness of two inches, seven folds are sufficient for this purpose as shown in FIG. 2. It will be evident that if the blanket thickness is only one inch, fourteen folds would be required.

In the event that blanket material of sufficient width is unavailable, a functional equivalent of the continuous Z folded configuration can be readily made up of a series of U folds placed side-by-side, with all the free edges of such U-shaped folds or sections being seated against and cemented to the blanket 24. The important consideration is that the Z fold as well as the assemblage of U folds present only U-shaped bends or folds at the upper boundary of the structure with all ends terminating at the blanket 24. It will be manifest to those familiar with the art that any combination of Z-folds and U-folds may be employed provided that all free edges terminate at and are preferably cemented to the blanket 24.

It will be evident that if the desired overall height of the module 10 exceeds that realizable by the width of available blanket material, resort must of necessity be made to using a plurality of U-folds, Z-folds or any combination of the same provided the lateral edges face downwardly toward and are preferably cemented to the blanket 16 or any intervening aluminum sheet or foil.

Not only is the blanket 40 compressed laterally from 20% to 40% (preferably about 30%) at its juncture with the blanket, whether it be compressed of a single piece as shown or a plurality of U-folds, Z-folds, etc., it is urged against and cemented to the upper surface of the blanket 16 so as to virtually exclude the existence of voids at the juncture of the blanket 14 with adjacent folds of the blanket 40. If desired or deemed expedient, a sheet of aluminum foil, not shown, can be interposed between the folded blanket 40 and the upper blanket 16, with such blankets being cemented to the sheet of the aluminum foil separating or interposed between the same.

It will be evident that if the unfolded width of the blanket 40 is 48 inches, its vertical folded height above the blanket 16 will depend upon the thickness of the blanket; the thicker the blanket, the greater the height of the folded blanket 40 for the reason that fewer folds are required for a given width of module. For a one-foot wide module 10 and using a blanket 40 of four feet unfolded width, the height of the folded blanket 40 upon the blanket panel 16 will range from about $4\frac{1}{2}$ inches when one-inch thick blanket is used and will be about $7\frac{1}{2}$ inches when two-inch thick material is used. For heights of folded blanket that exceed the 48 inch width, a joint can be made of additional blanket to achieve the desired height by making a joint that occurs at contact with item 16. Blanket does not necessarily have to be of one continuous length; folds or pleats can be incorporated where expedient.

A plurality of elongated retainer bars 50 are provided that are somewhat greater in overall length than the width of the blanket panel 16. The bars 50, which can be of mild or grade B-7 steel if desired of stainless steel, are of circular cylindrical configuration throughout most of their length with one end 54 being blunt and the opposite end pointed as indicated at 56 in FIG. 2. For a reason to be presently given, the bar 50 is flattened for short intervals 58 and 60 adjacent the ends 54 and 56 respectively. Retainer bars 50 are forced transversely through or shot by means of a suitable gun through the folded blanket 40 at spaced intervals along the length of the module 10. The pointed ends 56 of the bars 50 facilitate the latter being forced, pushed or shot through the folded blanket 40. The bars are uniformly spaced from and are parallel to the upper surface of the blanket panel 16, a vertical spacing of about $1\frac{1}{2}$ inches from the blanket 16 being quite satisfactory. As previously suggested, the retainer bars 50 are at right angles to the longitudinal extent of the module 10 and are of course parallel to each other. As the ceramic fiber material of the module 10 is fragile, it is desirable to provide the same with the protective cover or sheet 12 which serves yet another purpose as will be now described.

It will be apparent that a snug or void-free abutting relationship between modules mounted in the side-by-side relationship, it is very important in accordance with the present invention that at least part of the folded blanket 40 remote from the blanket 16 be substantially compressed laterally, say about 16 to about 40 percent, prior to mounting or installation of the module 10. Approximately about 25 percent compression or compaction is usually preferred. The minimum desired compression or compaction is shown approximately in FIG. 2.

Indeed, it is also of importance according to the present invention that the degree of lateral compression progressively increases throughout the vertical height of the folded blanket 40. Such compression is such as to impart a trapezoidal transverse configuration to the folded blanket 40 as plainly shown in FIG. 2.

The protective cover 12 is such as to not only afford protection for the module 10 during shipment and storage of the same as well as also during the installation of the module 10 but also serves to retain the module 10 in the previously described laterally compressed condition until the module 10 is installed by apparatus and procedure yet to be described.

The protective cover 12 is generally of an inverted U-shape having a horizontal web portion 70 seated against the upper side of the folded blanket 40. The web 70 is integrally joined to downwardly divergent side walls 72 and 74 with the junctures 76 and 78 of the web 70 and the side walls 72 and 74 defining and retaining the upper portion of the folded blanket 20 in its laterally compressed configuration. The side wall 72 is shaped to extend about the tongue 28 of the blanket panel 14 and terminates in an inturned flange portion 80 that underlies the tongue 28. The other side wall 74 extends downwardly and terminates in an inturned flange 82 that is directed toward the flange 80 and which may be extended sufficiently to underlie an edge portion of the blanket panel 14. The side walls 72 and 74 including the flanges 80 and 82 at their lower ends are provided with vertical slots 84 and 86, respectively, that extend downwardly from the position of the retainer bars 50. The slots 84 and 86 enable the protective cover 16 to be vertically removed from the vase panels 14 and 16 and the folded blanket 40 on appropriate flexing of the side walls 72 and 74 and their flanges 80 and 82, with the slots 84 and 86 accommodating relative movement of the cylindrical portion 88 of the retainer bars 50 therethrough.

It will be understood that the protective cover 12 is sufficiently stiff to retain the module 10 in the configuration shown in FIG. 2, but is sufficiently flexible to permit its disengagement with and removal from the module 10 as indicated above. Means are provided to facilitate the retention of the module 10 in its compressed condition shown in FIG. 2, such means comprising a pair of plastic caps 90 and 92 that are associated with the retainer bars 50 in such a manner as to releasably hold the side walls 72 and 74 against movement from each other. It will be noted that the flattened portions 58 and 60 of the bar 50 constitute relatively radially enlarged parts thereof. The plastic caps 90 and 92 possess sufficient resiliency as to grip the portions 58 and 60 when pressed over the ends 54 and 56 of the bar 50 with the flared open ends 94 and 96 thereof bearing against outer faces of the side walls 72 and 74. It will be understood that when desired, the caps 90 and 92 can be readily disengaged from the bar 50 by pinching them in a direction normal to the flatness of the bar portions 58 and 60.

As thus far described, the module 10 with its protective cover 12 secured as shown in FIG. 2 constitutes a unit that can be conveniently handled, shipped and stored without unduly subjecting the module 10 to damage. It will be understood that the module 10 including its cover 12 cap optionally be enveloped or enclosed by what is conventionally called a shrink pack of polyvinyl material as an additional protective measure.

In any event (and prior to the application of any optional shrink pack) the module 10 and its protective cover 12 are held in condition shown thereof by conventional tight nylon banding applied about the assembly at spaced positions along its length, with such banding at about one foot intervals being shown as bands 98 in FIGS. 1 through 3.

With the exemplary dimensions heretofore given, the folded blanket 40 or its functional equivalent will have a finished width of approximately twelve inches at its juncture with the edges of the blanket panel 16 and have a width of about ten inches adjacent the lateral edges of the protective cover web 70. Not only can the unit shown in FIG. 2 be conveniently shipped and stored, such unit is installed as a unit by means now to be described.

Figure 4:
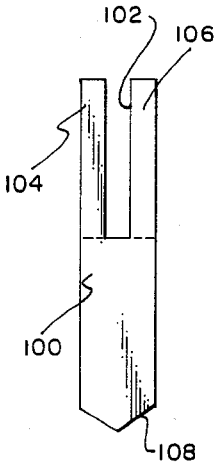
FIG. 4 is an enlarged front elevational view of a retainer bar support or mounting bracket.
Figure 5:
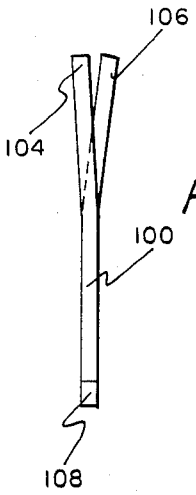
FIG. 5 is a side elevational view of the structure shown in FIG. 4.
Figure 6:
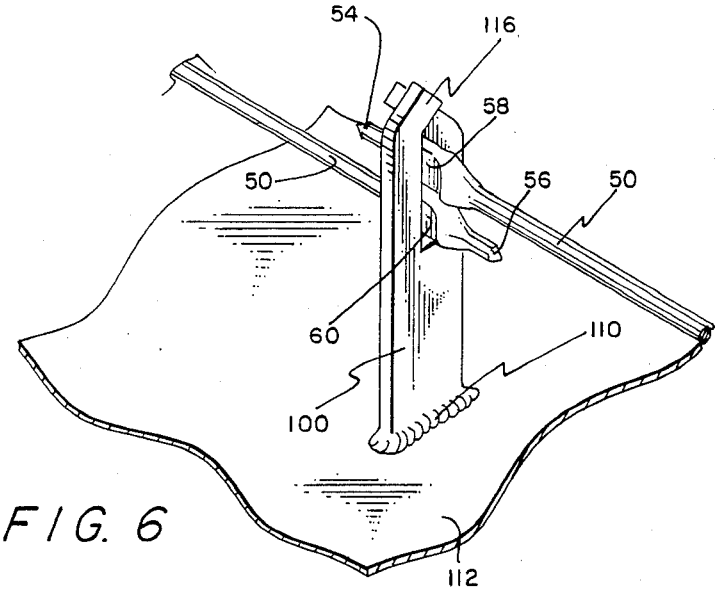
FIG. 6 is an isometric view of a retainer bar support welded to and projecting from a fragmentarily illustrated furnace shell or wall, and showing the bifurcated ends of the support bent to engage the overlapping ends of a pair of oppositely extending and fragmentarily shown retainer bars.

Referring now especially to FIGS. 4, 5 and 6, the reference numeral 100 designates a retainer bar mounting bracket, the same comprising an elongated steel strap, which may be stainless steel, that is bifurcated for approximately one-half its length from one end thereof by a longitudinal slot 102 that separates elongated fingers or tabs 104 and 106. As shown in FIG. 5, the tabs 104 and 106 are slightly bent at the inner end of the slot 102 to opposite sides of the plane of the remainder of the bracket 100 for a purpose to become apparent. The end of the bracket 100 opposite the free ends of the fingers 104 and 106 is pointed or wedge shaped as indicated at 108 for the purpose of facilitating timed delay of an electric stud welding gun or machine of the bracket 100 to a steel wall or shell or a boiler, furnace, or the like.

FIG. 6 illustrates on an enlarged scale a bracket 100 that is welded at 110 to a fragmentarily illustrated steel shell 112. The bracket 100 is welded to the steel wall 112 with the longitudinal extent of the bracket 100 being perpendicular to the surface of the wall or shell 112 at the point of attachment.

FIG. 6 also shows the manner in which the bracket 100 can accommodate and releasably engage overlapping end portions of a pair of approximately parallel retainer bars 50. The slot 102 has a width to accommodate the flattened bar portions 58 and 60 when one is placed above the other, in which case the fingers or tabs 104 and 106 project above such flattened portions 58 and 60. The material of the bracket 100 is sufficiently malleable that the upper extremities of the fingers or bifurcations 104 and 106 can be squeezed by a pair of pliers, or the like, so as to overlap and retain the flattened bar portions 58 and 60 in the slot 102 as indicated at 116. Should release of the bars 50 become necessary, such can be easily accomplished by bending the fingers 104 and 106 back to approximately their original configuration. Inasmuch as the flattened portions 58 and 60 are essentially identical to each other, it is immaterial which is uppermost. Furthermore, since the portions 58 and 60 are essentially merely flattened portions of a cylindrical bar or rod, the bars 50 are denied substantial endwise movement by reason of the narrowness of the slot 102.

Attention is now directed to FIG. 7 for an appreciation of the manner in which a plurality of units as shown in FIG. 2 are mounted in parallelism to a flat steel wall 120 which may have any orientation in space (vertical, horizontal, etc.). A rectangular array of brackets 100 are initially welded to the wall 120 in a pattern appropriate or corresponding to the disposition of the end portions of the bars 50 when a plurality of modules 10 are installed in side-by-side relationship thereon. In other words, assuming a module width of one foot, the individual brackets 100 of the row shown thereof in FIG. 7 are twelve inches apart and oriented to accommodate in the slots 102 thereof the end portions 58 and 60 of retainer bars 50 disposed in the plane of the exposed row of brackets 100. It will be clear that additional rows of brackets 100 are attached to the wall 120 with spacings therebetween corresponding to the spacing of the retainer bars 50 in a module 10. Again, the wall 120 can have any spatial orientation, and while FIG. 7 shows the modules 10 being disposed above a horizontal wall, the modules 10 could be just as readily disposed below the wall in which latter case, the brackets 100 would project downwardly rather than upwardly as shown in FIG. 7.

On further reference to FIG. 7 assume the rightmost and partially shown module 10, specifically identified by the reference numeral 140, to be the first of a series of modules 10 to be installed. Such module 140 with its protective cover 12 thereon is positioned as shown with the righthand ends of the bars 50 being fastened to brackets 100 that are not shown in FIG. 7 as they are to the right of the view shown in FIG. 7. It will be understood that the retainer bands 98 on module 140 are yet intact, though any shrink pack, if used, is removed before placement of the module 140 against or upon the wall 120.

The lowermost part of the side wall 72 of the protective cover 12 of module 140 is now folded back and upwardly sufficient to expose the uppermost blanket panel 16 thereof, which also serves to expose the excess of flap part 32 of the aluminum foil 20. The cover wall 72 can be cut, precut or have a perforate line of weakness, not shown, to enable folding back in the vicinity of the bands 98. The aluminum flap 32 is then folded down flush against the walls 120 to extend to the left of the module 140 to a position corresponding to the assembled position thereof shown in FIG. 2.

The caps 90 of module 140 are now removed (though this can be done before folding the flap 32) and the thus uncovered bar portions 58 positioned in the slots 102 of the adjacent brackets 100.

The lower end part of the cover wall 74 of the next module 10 to be installed (specifically module 142) is now folded back sufficiently to expose the recess of pocket 26 thereof; whereupon the module 142 is positioned to abut the wall 120 and the previously installed module 140 with its recess 26 receiving therein and thereunder the tongue 28 and the flap 32 of the module 140. The cover wall 74 can be cut, precut or have a perforate line of weakness, not shown, to enable folding back in the vicinity of the bands 98.

The flat portions 60 of the bars 50 of module 142 are positioned in the brackets 100 to overlap in the latter the retainer bars 50 of the module 140, and such brackets 100 are closed or crimped by pliers, not shown, to retain the overlapping bars 50 thereon.

As in the case of module 140, the bar portions 58 of the module 142 are placed in the next row of brackets 100, and if deemed necessary or expedient (as likely when the modules 10 are to depend from a wall 120) the fingers or bifurcations 104 and 106 can be slightly squeezed together to prevent inadvertent disengagement. If such a slight crimping of the bracket fingers is done, it will be evident that they can be readily pried apart sufficiently to accept therebetween the bar portion 60 of the next module 144 to be installed.

Now as in the case of the module 140, the protective cover wall 72 is folded back sufficiently to expose the left-hand edges of the blanket panels 14 and 16 and the aluminum flap 32 is folded against the wall 120.

The module 144 is then installed in the same manner as that described in connection with module 142, and such procedure is successively carried out with respect to modules 146, 148, and so on.

As soon as the installation of a module has been completed to the extent that both ends of all its retainer bars 50 have been pinched or gripped by the retainer brackets on the opposite sides of such module, the bands 98 thereof can be cut and carefully withdrawn. Actually withdrawal is not essential as they will eventually burn away. After the bands 98 are cut, the protective cover 12 thereof can be withdrawn, whereupon the compressed blanket 40 (or its compressed equivalent) which had previously been compressively retained between the side walls 72 and 74 of the protective cover 12 is free to resiliently expand laterally, the arrangement being such that when the protective covers 12 of two adjacently installed modules are removed, they resiliently expand laterally to abut each other and to protectively engulf the brackets or supports 100 as well as the end portions of the retainer bars 50 secured by such retainer bar brackets 100.

It should be pointed out at this point that while a protective cover 12 can be removed as soon as both ends of its retainer bars have been crimped within the retainer bar supports or brackets 100, it is preferred that the removal of the protective covers be deferred as long as possible, and this may well be substantially immediately prior to placing a complete installation or furnace installation job in operation. Such desirability is occasioned for the reason that until the protective covers 12 are removed, they provide protection to the modules and especially the folded blankets 40 thereof against inadvertent damage, and also for the reason that prior to removal of the protective covers 12, the retainer bar brackets or structures 100 are accessible for supervisory inspection and approval as well as for replacement of any module that may be found necessary.

The relationship of adjacent modules after their installation and removal of their protective covers is best shown in the enlarged sectional view shown in FIG. 9, wherein it will be seen that after the removal of the protective covers from the module 142 and of its adjacent modules 140 and 142, the folded blankets 40 of the modules 140 and 142 resiliently expand laterally to abut each other upon the plane of the line 150 throughout the vertical extent of such folded blankets 40. It will also be noted that the abutting portions of such folded blankets 40 engulf the retainer bar mounting bracket 100 between the modules 140 and 142. FIG. 9 illustrates well the fact that the entire mounting structure, namely, the bars 50 and the mounting brackets 100 are disposed a substantial depth below the upper surface 152 of the abutting modules 140 and 142, beneath which the disposition of the blankets is coherent, continuous and free of voids. With respect to voids, the space shown in FIG. 9 between the blanket 14 and the wall 120 is greatly exaggerated for clarity, and indeed the blanket 14 bears against the wall 120 with sufficient force to exclude any void therebetween.

In a similar manner the folded blankets 40 of the modules 142 and 144 expand laterally into abutting engagement along the plane of the line indicated at 154 with the retainer bars 50 and the brackets 100 therebetween being engulfed.

FIG. 9 also depicts the rabbet joint-like junctures between adjacent modules insofar as their base panels 14 and 16 are concerned, such joints being constituted of the tongue 28 of a module being received in the recess 26 of an adjacent module. Such general rabbet joint configuration serves to substantially attenuate vertical heat flow at a juncture of the blanket panels 14 and 16 of adjacent modules if such junctures occurred in a common vertical plane rather than that described and shown. Also FIG. 9 shows the aluminum foil material being applied most effectively to realize a vapor seal by reason of the virtually interlocking flaps 22 and 32 at the junctures between adjacent modules. If deemed necessary or expedient to enhance a vapor seal, a suitable cement can be applied to the flap 22 for adhesion to the aluminum foil portion 30 and the flap 32 at the time of module installation.

Figure 8:
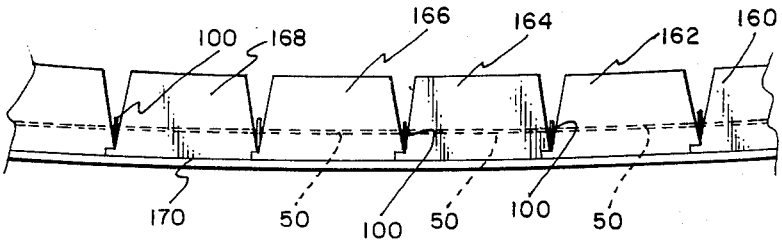
FIG. 8 is a view similar to FIG. 7, but showing the modules mounted upon a shell or wall of arcuate configuration.

Whereas FIG. 7 depicts the installation of a plurality of modules 10 upon a flat wall 120, FIG. 8 illustrates a corresponding set of modules 160, 162, 164, 166 and 168 mounted upon a steel wall 170 that is curvilinear. The wall 170 shown is conformable to a circular cylindrical surface having an axis parallel to the longitudinal extents of the modules 160–168. While the wall 170 is arched downwardly, the same could be upwardly, as the manner of installation of the modules 160–168 is identical in either case to the previously described installation of the modules 140–148 on the wall 120, it being noted that the resiliency of the material of the modules readily accommodates to the curvature of the wall 170 and the exclusion of voids therebetween, and that the brackets 100 readily accommodate angular misalignment of retaining bars 50 gripped thereby that is occasioned by the curve of the wall 170. The radius of curvature of the wall 170 is very small as compared to what is actually realizable in the practice of the invention, as it will be evident that the lateral compaction or compression of the module coupled with the very significant resiliency of the material allows the adjacent modules to seat against each other. The only limitation is the extent to which the entire vertical extent of the folded blanket is laterally compressed and the extent to which, on release, it can resiliently recover or expand toward its initial condition of repose prior to compression. Indeed, the resiliency of the material and the character of the mounting means allows mounting on walls that curve to a significant extent about an axis angled to the longitudinal extent of the modules 10.

A minor modification in the structure of the retainer bar support or bracket enables the mounting of modules 10 upon masonry walls and the like and such a modified bracket 100 is shown in FIGS. 10 and 11, and the same being designated by the reference number 180. The mounting bracket 180 is generally similar to the bracket 100 in that it has a slot 182 and fingers or tabs 184 and 186 that correspond to and serve the same functions as the corresponding parts 102, 104 and 106 of the bracket 100. Essentially the sole distinction between the brackets 100 and 180 resides in that the latter is provided with an integral centrally projecting stud 188 of generally circular cross section rather than the wedge configuration 108. The stud 188 is adapted to be driven into or cemented into a blind bore 190 drilled into a masonry wall such as shown in a fragmentary fashion at 192 in FIG. 10. It will be evident to those skilled in the art that the stud 188 can be hard material and pointed so as to be suitable for projectile-like wall penetration upon the provision of a suitable gun, not shown.

Upon encountering a corner, inside or outside, in the wall being insulated, the modules 10 can be readily modified for application to such corners. FIG. 12 shows a modified module 10 applied to the insulation of a wall 200 having an outside corner 202. Such modified module is designated at 204 and can be conveniently fashioned from a module 10 by cutting a longitudinally extending pie-shaped section from the bottom of the module 10 as viewed in FIG. 2 and then bending the module 10 to close sides of the cuts together with cement applied to the juncture of the surfaces. As the insulation material of the module is bent to close the gap, the bar 50 is also bent appropriately. Such results in the bar protruding from the opposite sides of the module. If such amount of protrusion is excessive, the ends can be conveniently trimmed for accommodation in adjacent retainer bar supports 100. In FIG. 12 the cemented juncture of the modified module 204 is indicated at 206 and the bent retainer bar is indicated at 208. It will be noted that the retainer bar 208 shares the supports 100 with the bars 50 of adjoining modules 10. It will be noted that the cover 12 can be deferred if desired during much of the module modification. It will be manifest to those skilled in the art that corner modules 204 can be fabricated directly rather than resorting to on the site modification of a module 10 as described. The same is also true with respect to an inside wall corner module now to be described.

In FIG. 13 a modified module 212 is applied to insulate the inside corner 214 of a wall 216. The module 212 can be readily made from a module 10. After removing the cover 12, a lingitudinal V-shaped or pie-shaped section is cut in the top (as viewed in FIG. 2) of the module 10 after which the cut surfaces, with cement applied thereto, are joined on bending of the module 10 and its bar 50. If desired, any resulting excess protrusion of the ends of the bar 50 can be sawn or nipped off with a bolt cutter (not shown), and the bar 50 ground or filed adjacent its ends for mating with the brackets or supports 100. In FIG. 13 the rejoined or cemented surface of the modified module 212 is indicated at 220, and the bent retainer bar is indicated at 222, it being noted that the extremities of the latter share the retainer bar supports 100 with adjoining modules 100.

Figure 15:
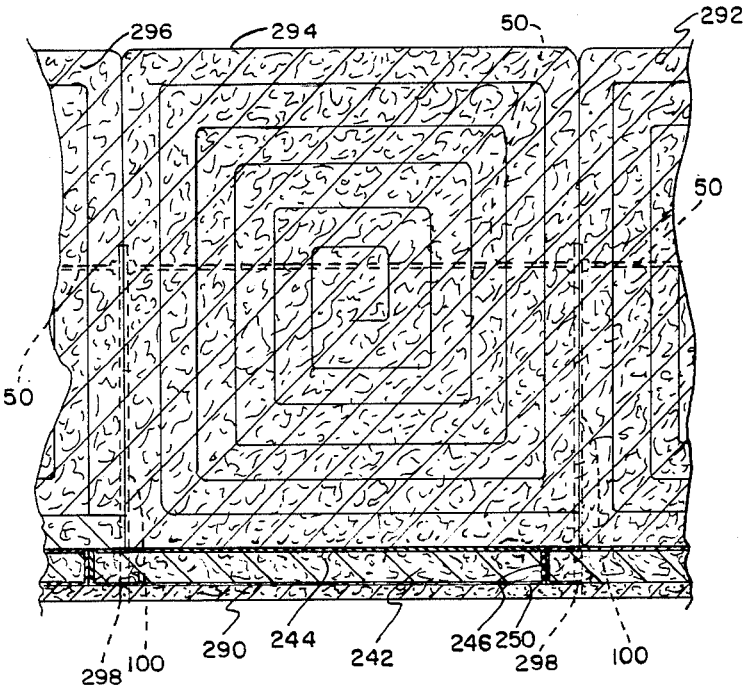
FIG. 15 is an isometric and fragmentary end view of a modified form of thermal module; and, FIG. 16 is an enlarged fragmentary sectional view generally similar to FIG. 9, but showing the mounting of the modified module of FIG. 15.
Figure 16:
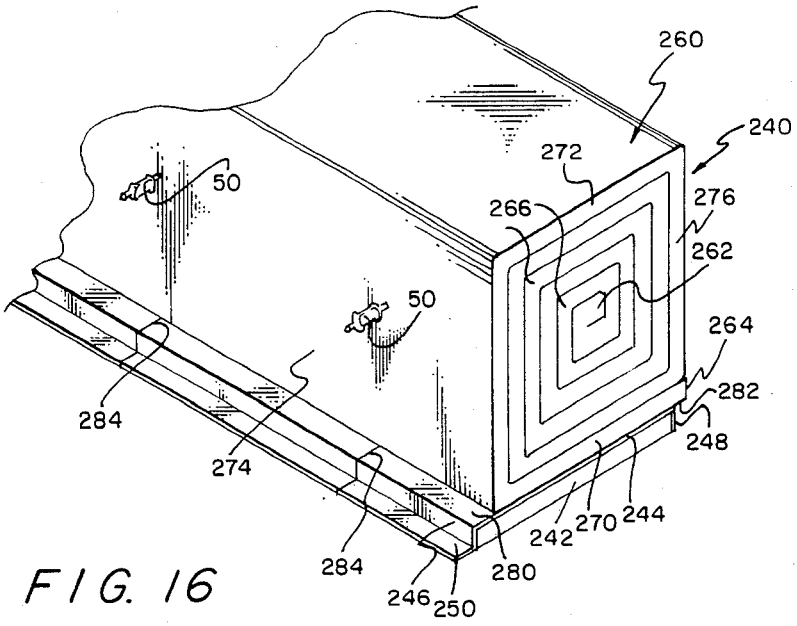
Figure 14:
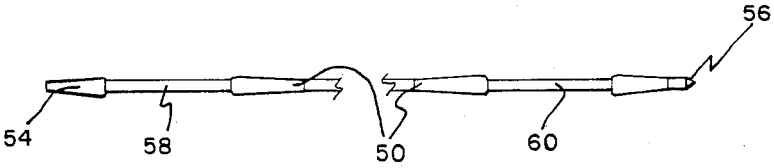
FIG. 14 is an enlarged and broken elevational view of the end portions of the retainer bar.

Attention is now directed to FIGS. 15 and 16 wherein a modified form of module is shown, the same being designated by the reference numeral 240. The module 240 is comprised of a rectangularly-shaped blanket panel 242 substantially similar to the previously described blanket panel. A rectangular sheet of aluminum foil 244 overlies and is cemented to the panel 242. Lateral portions 246 and 248 of the sheet 244 are cemented to the vertical lateral edges of the panel 242, with lateral marginal portions 246 terminating in a lateral flap portion 250 that serves as a counterpart for the flap 32 of module 10. The module 240 incorporates an elongated roll or generally spiraled configuration of blanket material designated generally at 260. The inner end of the roll 260 is designated at 262 and the outer or free end of the roll 260 is indicated at 264 with there being a plurality of blanket convolutions such as those indicated at 266 therebetween.

It will be readily apparent on inspection of FIG. 16 that the roll 260 has a generally rectangular or square overall transverse configuration rather than a substantially round configuration characteristic of rolled carpets or rugs. The generally rectangular configuration can be obtained by commencing the winding of the roll 260 upon a thin rectangular form, not shown, while deforming the roll 260 progressively during the winding of the same about the form to achieve the finally desired configuration shown thereof. At least the innermost turns are wound at least sufficiently tight so as to achieve a minor degree of radial compression within the roll 260, whereby when the form, not shown, is withdrawn, the position previously occupied by the same is filled in by blanket material by reason of its resiliency and compression. It will be obvious that the form, not shown, can be withdrawn prior to completion of the formed roll 260.

It should be mentioned at this time that the orientation of the fibers within the blanket material forming the roll 260 is such that they are wound about the axis of the roll 260 rather than being parallel to the axis or longitudinal extent of the roll 260. As described above, the roll 260 has a generally flat bottom layer 270, a generally flat top layer 272 and generally flat side layers 274 and 276. The free end 264 of the blanket forming the roll 260 terminates coplanar with the exposed outer face of the side layer 276. The bottom layer 270 has a lateral extent equal to that of the panel 242 and the roll 260 is cemented to the top of the panel 242 and the foil 244 in an offset fashion to define a tongue 280 and a recess quite analogous to the tongue 28 and recess 26 of the module 10.

As in the case of the module 10, parallelly spaced retainer bars 50 transversely extend through the roll 260 at uniformly spaced intervals along the longitudinal extent of the roll 260. Slots or slits 284 extend vertically through the tongue 280 in vertical planes coplanar with retainer bars 50, such slits may optionally additionally extend through contiguous portions of the aluminum foil.

As may be anticipated, the purpose of the very narrow slots or slits 284 is to accommodate the mounting brackets 100 therethrough when mounting the module 240. It will be understood that though not so shown, the tongue 28 of the module 10 is similarly slitted to accommodate the brackets 100. It is actually not essential to slit the aluminum foil in the vicinity of the slots in the tongues 28 and 280 as the flimsy character of the aluminum foil can be easily torn or ripped and dressed about the brackets 100 during module installation.

Though not shown, it will be evident to those skilled in the art, particularly in view of the preceding description of the module 10 and its protective cover 12 that the module 240 is laterally compacted and provided with a protective cover alike in principle to the protective cover 12 of the module 10. Thus the roll 260 is laterally compressed and retained in a generally trapezoidal transverse configuration for storage, shipping, handling and during the first phases of installation.

FIG. 16 illustrates the relationship existing between adjacent modules of the type indicated at 240 when mounted upon a wall or shell 290. The specific modules 292, 294 and 296 sequentially mounted on the wall 290 utilizing brackets 100 that are fixed to the wall 290 at 298 and the retainer bars 50 in a manner deemed evident in the light of the previous description of the mounting of the modules 140–144. It is deemed quite apparent the manner in which protective covers, not shown, for the modules 240 would be employed during module installation, and that they would serve for so long as needed to provide accessibility to the brackets 100 and the ends of the bars 50 projecting therethrough.

The provision of modules of rectangular shape and much greater length than width such as the modules 10 and 240, which may be conveniently twelve inches wide and twenty-five feet long, affords a very great advantage that a very large area may be insulated with all the modules being parallel to each other.

With modules all arranged in parallel and disposed so that their longitudinal extents are at right angles to the direction of flow of hot gases to which the modules are exposed greatly lengthens the life of the modules as the gas flow parallels the ceramic fibers directly exposed to such flow. Hot gas flow quickly erodes and destroys the integrity of blanket fibers when at right angles thereto. Consequently, the useful life span of parque arrays are much reduced. Also conventional mounting means are such that attempted replacement of a solitary module of a checkerboard or parque array is seldom successful and a large number of modules must be removed and replaced.

With modules 10 and 240 and their highly advantageous mounting means, the life span of an entire array of modules can be optimized, and even if one module need be replaced, it can be picked out carefully to expose the brackets 100 at its boundaries and its bars 50 removed. It is then possible to insert a replacement module that is in compressive restraint into position without undue damage to adjacent modules, whereupon the bars 50 thereof are secured and its protective cover removed to allow the replacement module to laterally expand and completely fill the void left by the removed module. It will be noted that the replacement module need only be of equal or preferably only slightly greater length than the module being replaced or the portion of the module removed, and need exert no great expansion forces at its ends.

The fact that the brackets 100 are disposed deep within and between adjacent modules that they hold in installed position contributes greatly to not only the ease of module installation, but is central to the selective replacement of a defective module. There, too, the supports 100 and the bars 50 are not subjected to temperature extremes.

Having described the invention sufficiently to enable others to practice and enjoy the same, and noting that the invention is susceptible to numerous variations without departing from the spirit thereof, attention is now directed to the appended claims for an appreciation of the actual scope of the invention.

I claim:

1. In structure for mounting ceramic fiber modules a pair of elongated retainer bar supports each having inner and outer ends with the inner end of each being adapted to be secured to a furnace wall, whereby the supports may be spaced from each other and secured perpendicularly to a wall to project their outer ends in spaced relation from the wall and from each other, an insulation module having an elongated retainer bar extending laterally therethrough, each of the supports being provided with holding means at its outer end for releasably holding an end portion of the retainer bar, said holding means comprising said support being bifurcated lengthwise from its outer end to a position spaced from its inner end to define a pair of fingers for receiving an end portion of the retainer bar therebetween, with such fingers being of a sufficiently malleable material to enable their being selectively bent to grip and pried apart to release an end portion of the retainer bar therebetween, said module being positioned intermediate the supports with the pairs of fingers respectively receiving therebetween and gripping the end portions of the retainer bar.

2. The combination of claim 1, including a second insulation module having a second elongated bar extending therethrough, and wherein the modules are in side-by-side relationship with one of the supports being disposed therebetween, and with the adjacent end portions of their respective retainer bars in overlapping relationship while the bars extend in approximately opposite directions from their overlapping end portions, and said pair of fingers gripping both the overlapping end portions of the bars, whereby each support intermediate a pair of side-by-side modules having their respective retainer bars in approximate alignment can have its fingers grip the adjacent ends of both of the bars.

3. An improved means for mounting a ceramic fiber module comprising a pair of retainer bar supports each having first and second ends with the first end being adapted to be secured to a furnace wall, whereby the supports may be spaced from each other and secured to a wall to project in the second ends therefrom, an elongated retainer bar which is adapted to extend laterally through a module, said second end of each of the supports being provided with means for holding an end of the retainer bar, whereby a module positioned against a furnace wall intermediate the supports will be constrained against lateral movement by the supports and against movement from the furnace wall by the retainer bar held at its ends by the spaced supports, and a ceramic fiber module comprising a base having an upstanding body portion thereon that is formed of ceramic fiber blanket material having a preferential direction of fiber orientation therein, said body portion having an upper surface and having all extremities of said blanket material transverse to the direction of figer orientation disposed below and spaced at least about one-half the vertical height of the body portion below said top surface, and said module having a transverse section defining mating tongue, and recess configurations along the opposite lateral sides of the base.

4. The combination of claim 3, wherein said module includes a layer of aluminum foil intermediate the body portion and the base that extends laterally to cover the top and edge of the tongue configuration.

5. The combination of claim 3, wherein the body portion includes a Z-fold.

6. The combination of claim 3, wherein the body portion includes at least one U-fold.

7. The combination of claim 3, wherein the body portion includes a spirally wound length of ceramic blanket material with the outermost extent thereof being seated against the base.

8. An improved ceramic fiber insulation module comprising a base having an upstanding body portion thereon that is formed of ceramic fiber blanket material having a preferential direction of fiber orientation therein, said body portion having an upper surface and having all extremities of said blanket material transverse to the direction of fiber orientation disposed below and spaced at least about one-half the vertical height of the body portion below said top surface, and said module having a transverse section defining mating tongue, and recess configurations along the opposite lateral sides of the base.

9. The combination of claim 8, wherein said module includes a layer of aluminum foil intermediate the body portion and the base that extends laterally to cover the top and edge of the tongue configuration.

10. The combination of claim 8, wherein the body portion includes a Z-fold.

11. The combination of claim 8, wherein the body portion includes at least one U-fold.

12. The combination of claim 8, wherein the body portion includes a spirally wound length of ceramic blanket material with the outermost extent thereof being seated against the base.

13. An improved ceramic fiber thermal insulation module comprising a body portion constituted of at least one length of a ceramic fiber blanket, said module including a horizontal base underlying the body portion that is also formed of a ceramic fiber blanket material, with a lateral portion thereof projecting laterally at one side of the module to constitute a tongue, said module having a configuration at its other side that defines a recess horizontally bounded by the base, whereby the tongue of one module can mate with the recess of a laterally adjoining module, said length of blanket having a fiber orientation therein that is essentially parallel to the local extent of the blanket, said body portion being secured to the base and generally rectangular in transverse section and substantially continuous and substantially free of voids other than those intermediate fibers that are adjacent to each other within a blanket, with each length of said blanket constituting having two ends and being so arranged that both of said ends are remote from the uppermost and generally horizontal surface of the body portion.

14. The combination of claim 13, including vapor barrier means isolating the base and the body portion.

15. The combination of claim 14, wherein said barrier means is a sheet aluminum foil and has a width sufficiently great to enable an overlapping barrier continuity with an adjacently installed module.

16. The combination of claim 13, including means for retaining the module in installed position, with such means including a horizontal and elongated retainer bar transversely extending through the body portion.

17. The combination of claim 8, including a horizontal and elongated retainer bar laterally penetrating through said body portion of the module at a position at least about one-half the height thereof below said upper surface.

18. The combination of claim 8, wherein said body portion of said module is laterally compressed into a generally trapezoidal configuration and provided with a protective cover and banding retaining said module.

19. The combination of claim 8, wherein the body portion is laterally compressed into a generally trapezoidal configuration, a cover partially surrounding the compressed module and having a transverse configuration conformable to the trapezoid, a horizontal and elongated retainer bar extending transversely through the body portion and the cover on opposite sides of the body portion, said bar having exposed extremities thereon projecting outwardly from the cover with means operative with the exposed extremities of the bar to releasably prevent removal of the cover.

20. The combination of claim 19, including a removable band snugly embracing the module and its cover.

21. The combination of claim 19, wherein the body portion is a wound helix of ceramic fiber blanket material.

22. The combination of claim 19, wherein the body portion is a Z-fold of ceramic fiber blanket material.

23. The combination of claim 19, wherein the body portion includes at least one U-fold of ceramic fiber blanket material.

24. The combination of claim 19, wherein the exposed extremities of the bar include portions adapted for mounting the module, and a pair of retainer bar supports adapted for attachment to a furnace wall, with each of said supports being provided with means for secured engagement with said portion of the retainer bar.

25. An improved method for mounting ceramic fiber modules comprising the step of laterally compressing the module into a generally trapezoid configuration, and maintaining such compressed configuration while providing a protective cover therefor during placement of the module into its position of installation on a furnace wall, securing the module to the furnace wall in its position of installation, and thereafter discontinuing the protective cover while allowing the module to expand laterally from its compressed trapezoidal configuration.

* * * * *